US007079622B2

(12) United States Patent
Chretien

(10) Patent No.: US 7,079,622 B2
(45) Date of Patent: Jul. 18, 2006

(54) METHOD FOR SUPPLYING POWER TO A HEATING ELEMENT OF A SOURCE OF RADIATION AND CORRESPONDING SOURCE

(75) Inventor: Patrick Chretien, Issy les Moulineaux (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 138 days.

(21) Appl. No.: 10/841,134

(22) Filed: May 7, 2004

(65) Prior Publication Data

US 2004/0264643 A1 Dec. 30, 2004

(51) Int. Cl.
*H05G 1/34* (2006.01)

(52) U.S. Cl. ..... 378/109; 378/110

(58) Field of Classification Search ..... 378/109, 378/110

See application file for complete search history.

(56) References Cited

U.S. PATENT DOCUMENTS 4,366,575 A * 12/1982 Bax ..... 378/110
4,775,992 A 10/1988 Resnick et al.
5,546,441 A * 8/1996 Stege ..... 378/110

FOREIGN PATENT DOCUMENTS

DE 16 39 397 A 2/1971
FR 2 718 599 A 10/1995

* cited by examiner

*Primary Examiner*—Edward J. Glick
*Assistant Examiner*—Krystyna Suchecki
(74) *Attorney, Agent, or Firm*—Cantor Colburn LLP

(57) ABSTRACT

A method for determining the heating time constant of a cathode of an X-ray tube. The value of a boost current applied during a preliminary period must be a function of both a pre-existing heating holding current and a service current to be used subsequently. A model of evolution of cathode temperature produces a minimizing tube current error between a tube current that is expected for the tube and a tube current obtained. The model requires only four parameters that need to be computed.

26 Claims, 3 Drawing Sheets

METHOD FOR SUPPLYING POWER TO A HEATING ELEMENT OF A SOURCE OF RADIATION AND CORRESPONDING SOURCE

CROSS-REFERENCE TO RELATED APPLICATIONS

This application claims the benefit of a priority under 35 USC 119(a)–(d) to French Patent Application No. 03 50162 filed May 20, 2003, the entire contents of which are hereby incorporated by reference.

BACKGROUND OF THE INVENTION

The present invention is directed to a method for supplying power to an element of a source of radiation. In particular, the present invention is directed to a method for supplying power to a heating filament of a cathode of an X-ray tube. The invention can be used in medicine, especially in vascular type applications. The present invention is directed to the quality of images produced with X-ray tubes. The present invention also relates to the X-ray tube itself.

For the acquisition of a radiology image, an object, such as a body of a patient, is subjected to irradiation by X-rays, which go through the object and are partially attenuated in the object, the remaining irradiation being sensed by a detector, i.e., a film or an electronic detector. Instead of solid X-ray sources, electron tubes capable of producing X-rays are used as the source of radiation. Electron tubes are more flexible in their use. Electron tubes can be used to dictate the hardness of the X-rays produced (related to their energy and hence to the frequency of the photon radiation) and to the delivery rate of the X-rays produced.

The delivery rate of the X-rays is chosen as a function of the results of the measurements that are developed by means of an integration of the energy collected at the detector. Furthermore, to simplify the description, the larger the object the greater is the delivery rate needed if a significant part of the X-rays is to reach the detector. Since the detector has an energy-related dynamic range for developing results, the mean quantity of energy received by the detector, per surface element, should be located in the middle of this dynamic range (or at an expected value) so that the image contrast is distributed as efficiently as possible. If the accumulated energy is excessively strong, the detector is saturated and there is a loss of contrast for the transparent parts of the object. If, on the contrary, the energy received is too weak, the detector is under-exposed, and there is a loss of contrast for the thickest parts of the object.

The hardness of the X-rays is chiefly controlled by the high voltage between an anode and a cathode of the tube, while the delivery rate of the X-rays depends chiefly on the heating current of the anode. For the hardness the electrons liberated from the cathode strike the anode at speeds that are especially high as the high voltage is elevated. This striking of the anode leads to the production of X-rays of high energy value. And the same time, the number of the electrons that can be liberated from the cathode to be projected on to the anode depends especially on the state of excitation of the cathode which itself depends on its thermal state. Ultimately, the flow rate of the tube current, which is directly related to the X-ray delivery rate, is thus linked to the temperature of the tube.

The acquisition of a radiography image and, more generally a radiological examination therefore requires that, once the object, such as a patient, has been placed in an intermediate position between the tube and the detector, the tube should be made to send out irradiation during the exposure. The duration of the exposure is another multiplier factor of the accumulation of the energy sensed by the detector. For reasons of excessively fast wear and tear of the cathode through the spontaneous liberation of electrons, there are known ways of heating the cathode only when it has to make an emission. In practice, the cathode can be kept at a temperature far below the high temperature (around 4000° K.) that is its service temperature.

The pulsed operation to which the tube is subjected then runs up against a difficulty related to the time constant of thermal heating of the cathode. This difficulty delays the setting of the tube at its temperature. A cathode at excessively low temperature would send out an excessively weak tube current and, for a given duration of irradiation, the cumulated energy of the X-rays emitted would be different from the expected cumulated energy.

In order to overcome this problem, there is a known way of preheating the cathode, prior to the emission impulse, so that it reaches its service temperature. This preheating is however fairly slow and takes about four to five seconds. Such slowness is of course unacceptable in certain fields, especially in the vascular field where a contrast product is sent into the patient's blood at the same time as a radiographic exposure is taken of the arterial and venous distribution systems. This contrast agent spreads in the blood, in the form of a wave, imposed by the heartbeat. In other words, the improved contrast is visible only transiently, for a period close to one second and at a date that is a random date and related to the injection date and, in any case, having little compatibility with the waiting period of four or five seconds.

To overcome this problem, there are known ways of passing from the value of an electrical holding current (enabling the holding of the cathode heating) to a service current (corresponding to an expected X-ray delivery rate) by means of short-duration pulse imposing a boost current value on the heating current. For one and the same thermal time constant, the evolution in temperature of the cathode is then considerably quicker. After a calibrated duration of this boost current, generally equal to 400 milliseconds, the heating current of the cathode is imposed on a service value. This service value is in between the value of the holding current and the value of the boost current.

Generally, at the end of a subsequent stabilizing period that, in one example, is itself also equal to 400 milliseconds, the irradiation proper can be carried out. This irradiation, depending on the tube technologies used, may be prompted either by the switching of the high voltage between anode and cathode or by the switching of a voltage of the control grid interposed between the cathode and the anode. Such an approach gives good results, in any case better results than those obtained when the temporary boost current is not applied.

However, modem requirements as regards the control of the delivery rate are far greater. In particular, the mean delivery rate of the tube during the pulse should be contained within a window of ±10% about an expected mean value. It has been realized that, despite the boost current, major disparities occur and that the tube current cannot be controlled with the desired precision.

BRIEF DESCRIPTION OF THE INVENTION

An embodiment of the invention is directed to overcoming this problem. It has been found, by measurement that, in fact, the boost current does not have to be imposed once and for all in terms of value and duration but that, it should depend on the service current to be obtained (the current at which the service temperature of the cathode has to be stabilized), and the boost current should be a function of the holding current prior to the boost current. Driving and controlling the value of the boost current (in one example for a given duration of this boost current) has then made it possible to ensure that the mean current of the tube during the useful X-ray irradiation is contained in a window or of ±1,5% the expected current, namely at a value wholly in accordance with expectations.

In an embodiment, rather than using empirical methods and tabulating the value of the boost current as a function of the holding current and the service current, a particularly simple analytical model has been established. This model enables precise computation and has the advantage of being transposable from one tube to another. Indeed, from one X-ray tube to another, even for a same model, differences in nature result in different forms of behavior that no longer permit compliance with the tolerance envisaged here above. Rather than having to retrace a mapping of the different forms of behavior of each tube, a relatively simple series of experiments can determine the parameters of the model that concern the tube. The parameters of the model of a tube are proper to this tube. The model is common to all the tubes. This procedure resolves a problem of precision in the use of the X-ray tube and a problem of industrial-scale application in which the disparities between the tubes obtained are taken into account.

An embodiment of invention is directed to a method for supplying power to a heating element of a source of radiation preceding emission: heating the element to a holding temperature by means of a heating current whose intensity has a holding value; subjecting the heating element to a boosting of the heating current during a period preceding the emission; and after this period, subjecting the heating element to a current whose intensity has an intermediate value between the holding value and the value of the boost current, wherein the value of the boost current is determined, emission by emission, as a function of the holding value and the intermediate value.

An embodiment of the invention is directed to a source of radiation comprising a cathode with heating element; an anode; means for supplying power to the element; means for heating the element to a holding temperature whose intensity has a holding value, to subject the heating element to a boosting of the heating current during a period preceding an emission and, after this period, to subject the heating element to a current whose intensity has an intermediate value between the holding value and the value of the boost current; and means for determining the value of the boost current, emission by emission, as a function of the holding value and the intermediate value.

BRIEF DESCRIPTION OF THE DRAWINGS

The invention and embodiments thereof will be understood more clearly from the following description and the accompanying figures. These figures are given purely by way of an indication and in no way restrict the scope of the invention. Of these figures.

DETAILED DESCRIPTION OF THE INVENTION

Figure 1:
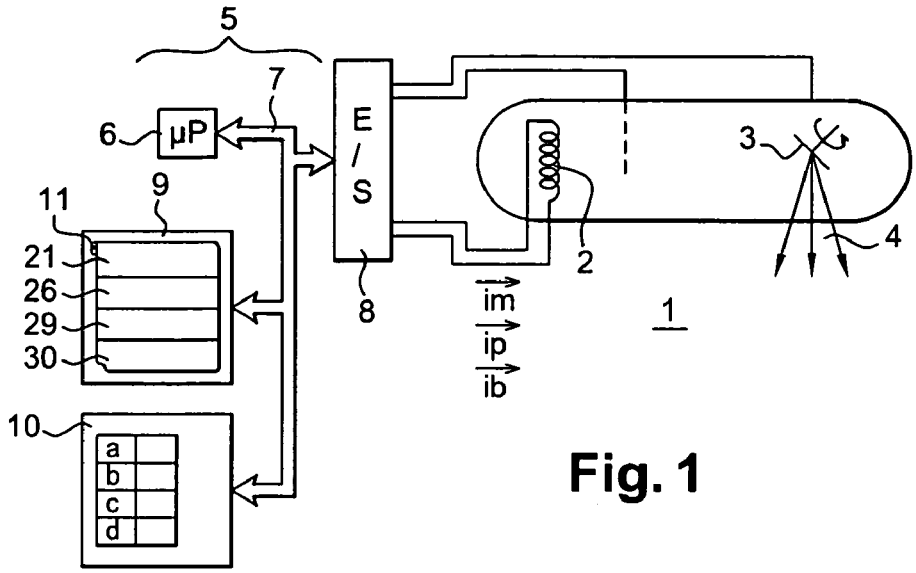
FIG. 1 is a schematic view of an X-ray tube that can be used to implement the method.

FIG. 1 shows an X-ray tube 1 that can be used to implement an embodiment of the method. Tube 1 comprises a cathode 2 and an anode 3, for example, of the rotating type. The cathode 2 is either a direct cathode or an indirect cathode. It is represented here by its heating element. When the cathode and the anode are subjected to high voltage relative to each other, the cathode 2 emits electrons at high speed that, in striking a target of the anode 3, prompt the emission by the anode of X-rays 4 used to perform radiography, especially in the medical field. The tube 1 comprises means for control 5 formed by a microprocessor 6 linked by an address, data and control bus 7 to an input/output interface 8, a program memory 9 and a data memory 10. The input/output interface 8 is designed to receive commands from a man-machine interface (not shown) that can be used to dictate a desired operation of the tube 1. A program 11 contained in the memory 9 is used to obtain the execution, by the microprocessor 6, of a sequence of operations of such that the X-rays 4 is strictly fixed at an expected value.

Figure 2:
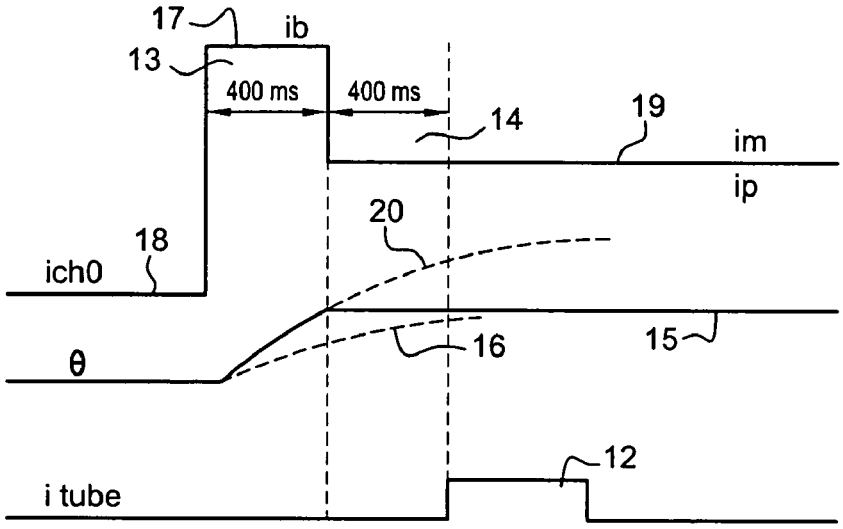
FIG. 2 is a schematic view of the steps for the preheating and overheating of the cathode when an emission is occurring.

In the field of vascular type radiography (FIG. 2), for example, the heating holding current ich0 is permanently imposed on the input/output interface 8 to supply power to the filament 2 of the cathode. FIG. 2 gives a view, below the timing diagram of the heating current, of a graph of temperature θ of the cathode. Below the graphθ, the figure shows the tube current i, also known as the anode current, directly representing the delivery rate of the X-rays 4. In a known way, before an exposure 12, during which the irradiation is emitted, the cathode 2 is preheated by a boost current ib for a given period 13 equal, in one example, to 400 milliseconds. Here below in the explanation, this exemplary duration of 400 milliseconds is chosen. But thereafter we shall show how it is possible especially with the model to choose another duration. The 400-millisecond duration however is a preferred duration because it corresponds to a normal load on the cathode 2.

After the period 13 during which the boost current is applied, it is possible to bring about the exposure 12. However, in the prior art, it is preferred to wait for a stabilization period 14 which itself, in one example, is also equal to 400 milliseconds before making the exposure 12 proper. In an embodiment of the invention, it is possible for such duration 14 not to be obligatory. During the stabilization period 14 and during the exposure period 12, the cathode current ip is a current with an intermediate value between the value ich0 of the holding current and the value ib of the boost current.

FIG. 2 also gives a schematic view of the utility of using a boost current period 13. If a boost current period 13 were not used, the temperature of the cathode would reach its stabilized temperature 15 with a slow evolution 16 related to its thermal constant. Applying the boost current, and with approximately the same thermal constant, the service temperature 15 is reached at the end of the boost current period 13, well before the starting date of the exposure 12. Consequently, with a boost current, the stabilization temperature 15 can be attained with greater precision.

In an embodiment of the invention however, it has been realized that the boost current, inasmuch as it is determined once and for all, whatever the values of the preliminary holding currents ich0 and whatever the values of the intermediate service currents ip, is not satisfactory and leads to an excessive dispersion of the mean values of the service currents during the exposure 12. In an embodiment of the invention, the value 17 of the boost current ib during the period 13 is made to depend on the value 18 of the holding current ich0 prior to the exposure 12 and on the value 19 of the intermediate-value service current ip that can be used during the exposure 12. This dependence is related to the duration of the period 13.

Naturally, such a method and such a device are particularly useful when the examination to be made is a vascular type of examination for which the date of the exposure 12 must be randomly determined and when it is appropriate to reduce the periods of preparation to the maximum extent, or even pass to the stabilization period 14. FIG. 2 schematically shows that the preheating time constant 20 due to the boost current 17 enables the service temperature 15 to be reached exactly at the end of the period 13.

Figure 3:
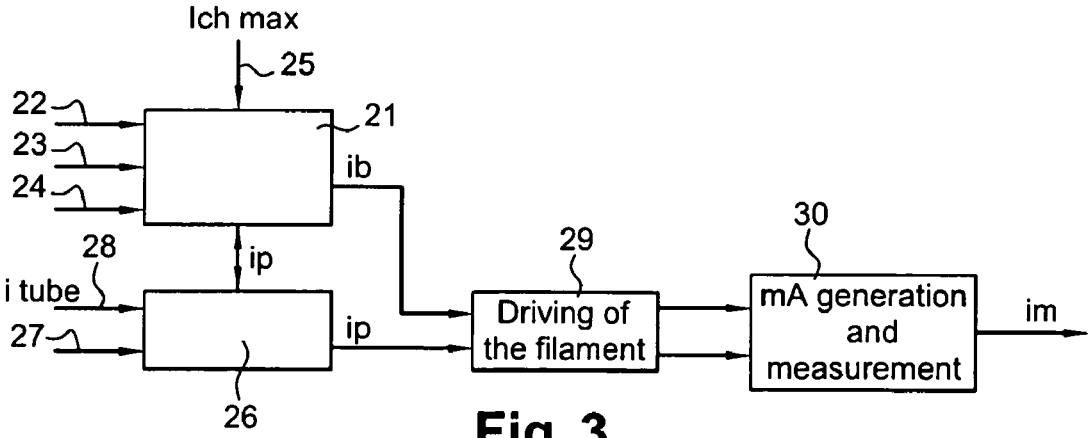
FIG. 3 shows the principle of the preparation of the setting parameters and, once these parameters are known, the principle of the setting of the X-ray tubes to obtain the expected emission.

FIG. 3 shows the program that is implemented by the circuit 5 in order to lead to a precise and expected setting of the service temperature. A first sub-program 21 receives information on the duration 22 of the period 13, the duration 23 of the period 14, and the duration 24 of the holding current (having the value 18). The sub-program 21 furthermore receives a piece of information 25 ich max indicating the value of heating current not to be exceeded if the cathode 2 is not to suffer deterioration. The sub-program 21 of the program 11 therefore makes a computation, for the duration 22 of the period 13, of the value 17 of boost current hereinafter called ib, as in "i boost" for boost current. The sub-program 21 is a model for the computation of the boost current of the filament.

The program 11 furthermore has another sub-program 26 used to model the behavior of the heating current as a function of a piece of information 27 on high voltage to be applied and an expected value of tube current 28. The sub-program 26 therefore produces a piece of information ip, with a value ip 19, indicating the value of the service current to be used to keep the cathode 2. The sub-program 21 also receives the information ip to enable the computation of the boost current ib 17. Once these different elements have been computed, a sub-program 29 of the program 11 enables the effective commanding of the cathode 2 and the anode 3 with the computed values. The tube 1 is then made to operate as a function of the different parameters and the exposure 12 is produced. A sub-program 30 is then used to measure the reality of the tube current produced (and its equivalent im in heating current) during the exposure 12. It is compared with the expected value ip. When this is done, there is a means available to adjust the parameters of the sub-program 21 so that the value im is equal to the value ip, tube by tube.

In practice, each installation, when it comes off the production line, is provided with the sub-program 21 parameterized with standard parameters. These standard parameters are adjusted during a phase of calibration of the installation, in a limited number of experiments. Then, once the parameters are adjusted, the installation is delivered to the customer. If necessary, it is possible during the ageing of the installation, to modify the parameters of the sub-program 21 by means of the program 30, from time to time or periodically. It is possible, however, to envisage the delivery of an installation in which the program 11 does not comprise the sub-program 30, the parameterizing having been done in the production unit once and for all.

Figure 4:
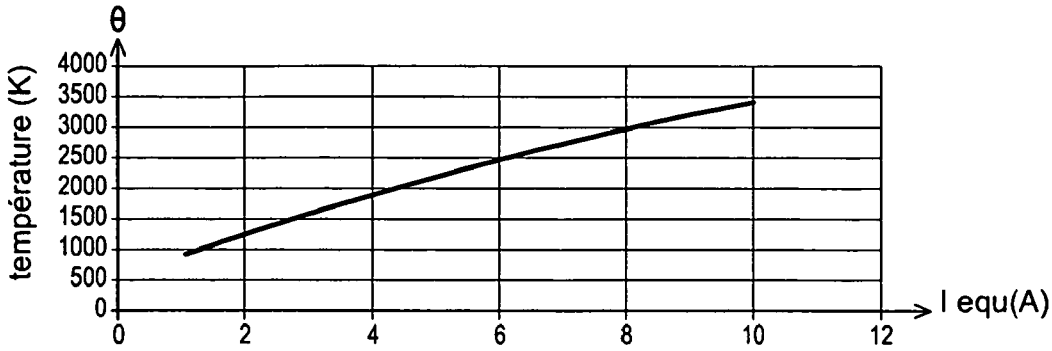
FIGS. 4 to 8 are graphs used to give a better explanation of the method.

FIG. 4 is a graph of correspondence between a temperature θ of the filament and an equivalent tube current. From the values plotted in FIG. 4, it is possible to deduce an equation for the conversion of the anode temperature θ into an equivalent tube current Iequ. This equation 1 is: $Iequ=\alpha\theta^4+\beta\theta^3+\gamma\theta^2+\delta\theta+\lambda$. With this formula 1, it is then possible to obtain a simulation of the behavior of the filament for a planned duration, for example 400 milliseconds in the preferred case, of the boost current period 13. This simulation takes account of the resistivity of the filament, the nature of the material that constitutes it, and the physical data that enable its temperature to be known at the end.

Figure 5A:
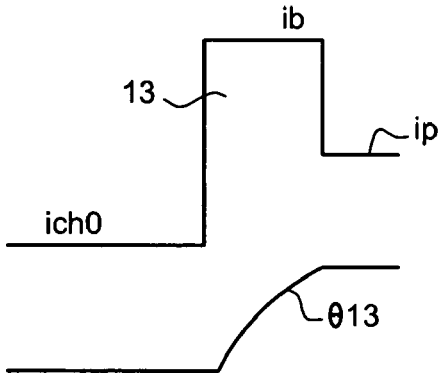

FIG. 5*a* shows firstly the evolution of the filament in temperature during the boost current 13, and secondly the value ip, equivalent to the temperature θ13 reached at the end of the duration 13.

Figure 5B:
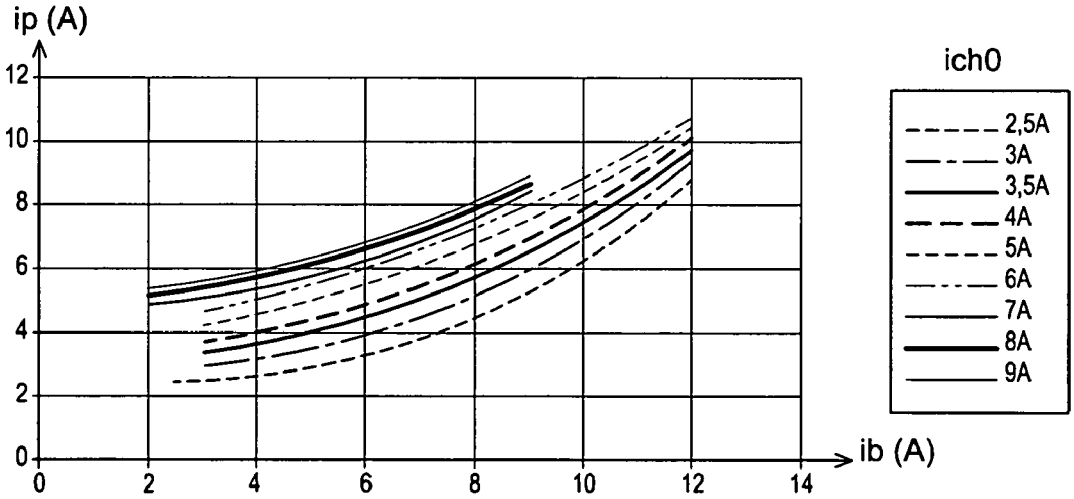

The curves shown in FIG. 5*b* give the results of this simulation, each as a function of a value of the current ib. There are nine curves represented, parameterized as a function of the value ich0 of the holding current prior to the period 13. The curves very roughly have the shape of a parabola portion showing that the expected current ip is at least a second-degree function of the current ib. Furthermore, of course, an expected service current (represented by the horizontal line of the graph 5*b*) is obtained all the more quickly as the boost current is great. Or again, the lower the holding current, the greater should the boost current be during the pulse 13.

Figure 6:
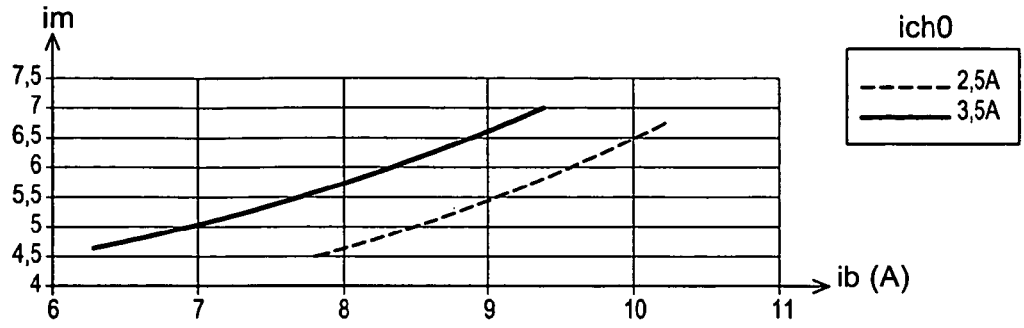

FIG. 6 gives a view, for certain conditions of FIG. 5*b*, of the measurement im of the measured heating current corresponding to the experiments of FIG. 5*b*.

Figure 7:
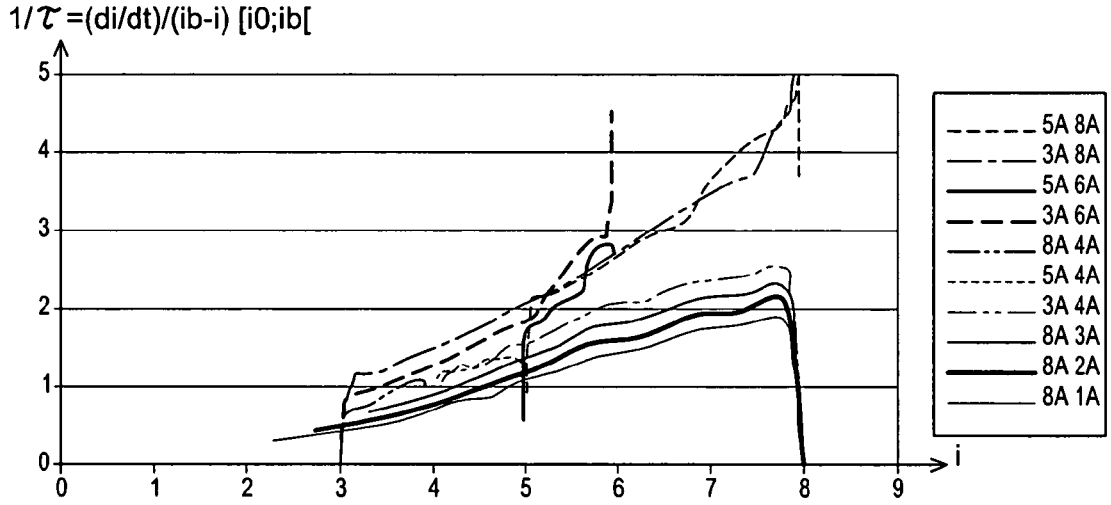

FIG. 7 shows the elements used to determine a simulation model. The model enables the simplification, for a tube, of the determining of the boost current ib without its being necessary to carry out the mapping shown in FIG. 5*b*, for this tube and therefore for each of the tubes that might be produced. Firstly, the acquisition of this mapping would entail a lengthy and painstaking process. Secondly, it would either make it necessary to take up a great deal of memory or entail more complex necessities of interpolation to obtain the requisite precision. In an embodiment of the invention, it was realized that the problem stems from the evolution of the filament heating time constant owing to the different conditions in which it was made to work. An embodiment of the invention is directed to measuring the drift in the value of the heating current. The heating current depends on the resistivity of the cathode filament, which itself depends on the temperature of the cathode, which itself evolves in time. During the period 13, the thermal energy transferred to the cathode 2 is therefore not constant and leads to the time constant. This evolution furthermore takes account of the technical dissipation that occurs constantly. An embodiment of the invention is directed to standardizing this drift with respect to the difference likely to result between the boost current ib and the current i obtained. The curve 7 shows the form taken by this evolution, referenced 1/τ, for a semi-open interval of values ranging from the heating current ich0 to the value ib. The interval is semi-open because, for i=ib, the standardization leads to an infinite value. The curves have been represented for pairs of values shown on the right-hand side of the graph of FIG. 7.

These curves, which show an asymptote when i comes close to ib, have the overall shape of a straight line and have been interpreted as representing a linearity of evolution.

Indeed, if the thermal time constant T of the filament had not varied with the temperature, an equation 2 could have been written as follows:

$ip=ib-(ib-i0)*\exp(-t/\tau)$, with $\tau$ as a constant, that is $dip/dt=(ib-i0)*\exp(-t/\tau)/\tau$ that is $dip/dt=(ib-ip)/\tau$ that is $1/\tau=dip/dt/(ib-ip)$ With a first-order model, a constant would be obtained for $1/\tau$. This is not verified with the model shown since, on the whole, the curves lead to an equation 3:

$$1/\tau = di/dt/(ib-i) = a + b*ib + i*(c + d*ib), \quad \text{that is}$$

$$ip = ib - \frac{ib - i0}{(\tau(ib)/\tau(i0))\cdot(e^{t/\tau(ib)} - 1) + 1}.$$

$$\text{with } .\tau(ib) = 1/(a + b*ib + c*ib + d*ib*ib), \text{ and}$$

$$\text{with } .\tau(i0) = 1/(a + b*ib + c*i0 + d*ib*i0),$$

Figure 8:
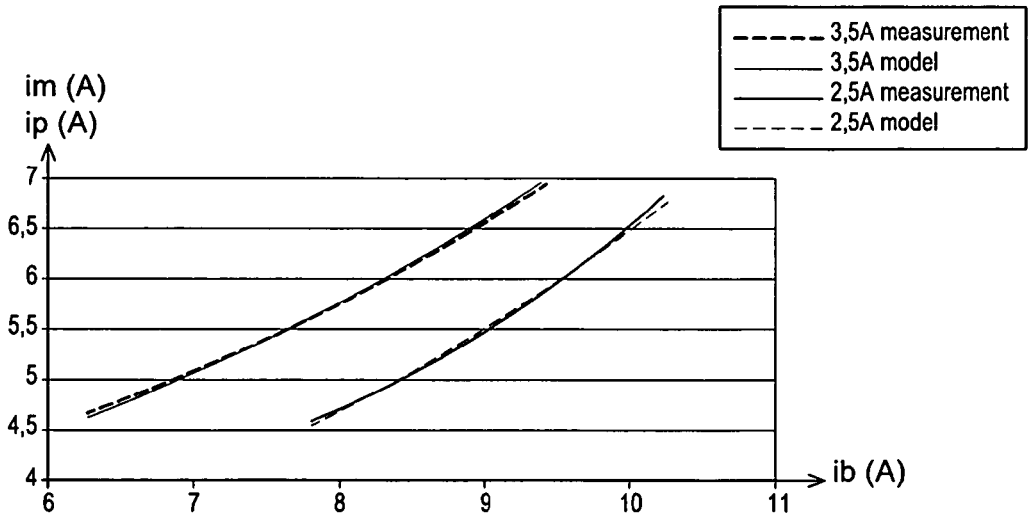

This reduces the complexity of the model to a simple model with four coefficients a b c d. It is generally not necessary to consider a fifth coefficient taking into consideration the square of the boost current of the holding current. It could be shown that taking these other variables into consideration would be of marginal value for the expected precision that is in the range of 1.5%. In this respect, FIG. 8 gives a view, using very finely intermingled curves for the model and the measurement, of the value of the service current computed on the one hand and measured on the other, as a function of the value of the boost current. This is done for two exemplary holding currents, ich0 at 2.5 and 3.5 amperes respectively.

Experiments have shown that the model thus computed is valid with an efficiency of about 1.5% that is far greater than the 10% expected. In one example, the parameters a, b, c, d have the following values depending on whether the cathode produces a small focal spot or a large focal spot on the anode.

small focal spot: a=−0.9658; b=0.0504; c=0.4072; d=0.0124 large focal spot: a=−0.4045; b=0.0416; c=0.2663; d=0.0215

As can be seen, the computation recommended by equation 3 does not directly give the value of the boost current ib with the service current ip and the holding heating current ich0 being known. In practice, the procedure is carried out by iteration in taking a value that is known to be at the upper limit of possible values for the heating current and a value that is known to be at the lower limit of possible values for the heating current. For example, the value known to be at the upper limit is the value of the maximum heating current ich max. The value known to be at the lower limit is the value of the holding heating current ich0. Then, the method proceeds by dichotomy. For example, a computation is made of the value of the heating current resulting from a choice of an intermediate boost current, for example equal to half of the sum of the two values, the upper limit value and the lower limit value. Depending on the difference noted between the value of the computed service current and the desired value, gradual modifications are made in the value of the boost current to compute a new value of the service current that is closer to the expected service current than a previously computed value. The computation is stopped when the error is below a threshold, for example set at 3 mA. In practice, at the end of three or four iterations, which may be very fast because the computation is nevertheless fairly simple, the value of the boost current is obtained. All these computations can very easily be contained in a computation period of less than one millisecond with a modern processor working at the rate of one gigahertz. The error is thus computed by determining the value of the boost current as a function of a chosen model of evolution of the heating current. The chosen model of evolution causes a minimizing of a tube current error between a tube current that is expected for the X-ray tube and a tube current that is obtained. In practice, the tube current may be replaced by its equivalent heating current (for a given high voltage).

One skilled in the art may make or propose various modifications in structure/way and/or function and/or results and/or steps of the disclosed embodiments and equivalents thereof without departing from the scope and extant of the invention.

What is claimed is:

1. A method for supplying power to a heating element of a source of emitted radiation comprising:

heating the element to a holding temperature by a heating current whose intensity has a holding value;

subjecting the heating element to a boosting of the heating current during a period preceding emitting radiation; and subjecting the heating element, after this period, to a current whose intensity has an intermediate value between the holding value and the value of the boost current, wherein the value of the boost current is determined, emission by emission, as a function of the holding value and the intermediate value, and wherein the value of the boost current is determined as a function of a model of evolution of the heating current, such that, emission by emission, the value of the boost current is allowed to differ.

2. The method according to claim 1 wherein the source is applied to a radiology examination.

3. The method according to claim 2 wherein:

the value of the boost current is determined as a function of a model of evolution of the heating current; and the model of evolution is a model that produces a minimizing of a source current error between a source current that is expected for the source end a source current obtained.

4. The method according to claim 3 wherein the model comprises the following equations:

$$ip = ib - \frac{ib - i0}{(\tau(ib)/\tau(i0))\cdot(e^{t/\tau(ib)} - 1) + 1}.$$

$$\text{with } .\tau(ib) = 1/(a + b*ib + c*ib + d*ib*ib), \text{ and}$$

$$\text{with } .\tau(i0) = 1/(a + b*ib + c*i0 + d*ib*i0);$$

where ip is the element current at the beginning of emission; ib is the boost element overcurrent; i0 is the initial current; t is a constant and a–d are parameters of the source; and wherein the boost current value ib is determined by iterations, the value i0 of the holding current and the intermediate value ip being known.

5. The method according to claim 4 wherein the parameters a, b, c, and d have the following values, depending on whether the cathode produces a small focal spot or a large focal spot on the anode:

small focal spot: a=−0.9658; b=0.0504; c=0.4072; d=0.0124 large focal spot: a=−0.4045; b=0.0416; c=0.2663; d=0.0215.

6. The method according to claim 5 wherein the parameters a, b, c, and d are determined by the minimizing of an error detected between an expected tube current and a detected tube current.

7. The method according to claim 4 wherein the parameters a, b, c, and d are determined by the minimizing of an error detected between an expected tube current and a detected tube current.

8. The method according to claim 2 wherein the period has a duration of 400 milliseconds.

9. The method according to claim 1 wherein:

the model of evolution is a model that produces a minimizing of a source current error between a source current that is expected for the source and a source current obtained.

10. The method according to claim 9 wherein the model comprises the following equations:

$$ip = ib - \frac{ib - i0}{(\tau(ib)/\tau(i0)) \cdot (e^{t/\tau(ib)} - 1) + 1}.$$

$$\text{with } .\tau(ib) = 1/(a + b*ib + c*ib + d*ib*ib), \text{ and}$$

$$\text{with } .\tau(i0) = 1/(a + b*ib + c*i0 + d*ib*i0);$$

where ip is the element current at the beginning of emission; ib is the boost element overcurrent; i0 is the initial current; t is a constant; and a–d are parameters of the source; and wherein the boost current value ib is determined by iterations, the value i0 of the holding current and the intermediate value ip being known.

11. The method according to claim 10 wherein the parameters a, b, c, and d have the following values, depending on whether the cathode produces a small focal spot or a large focal spot an the anode:

small focal spot: a=−0.9658; b=0.0504; c=0.4072; d=0.0124 large focal spot: a=−0.4045; b=0.0416; c=0.2663; d=0.0215.

12. The method according to claim 11 wherein the parameters a, b, c, and d are determined by the minimizing of an error detected between an expected tube current and a detected tube current.

13. The method according to claim 10 wherein the parameters a, b, c, and d are determined by the minimizing of an error detected between an expected tube current and a detected tube current.

14. The method according to claim 10, wherein the period baa a duration of 400 milliseconds.

15. The method according to claim 9 wherein the period has a duration of 400 milliseconds.

16. The method of claim 9, further comprising:

using the model of evolution to adjust heating parameters associated with the heating element so that the value of the source current obtained is equal to the value of the source current expected.

17. The method according to claim 1 wherein the period has a duration of 400 milliseconds.

18. The method according to claim 1 wherein the period precedes the emission by a duration of stabilization, approximately equal to 400 milliseconds.

19. A computer program comprising code means tat when executed on a computer carry out the steps of claim 1.

20. A computer program on a carrier carrying code that when executed on a computer carry out the steps of claim 1.

21. The method of claim 1, wherein:

the end of the period coincides with an acceptable service temperature at a cathode of the source of emitted radiation.

22. The method of claim 1, further comprising:

using the model of evolution to adjust the value of the boost current so that a resulting service current at the element is closer to an expected service current than a previously computed value, and stopping the computation in response to a current differential being below a threshold.

23. A source of radiation comprising:

a cathode wit a heating element;

an anode;

means for supplying power to the element;

means for heating the element to a holding temperature whose intensity has a holding value, to subject the heating element to a boosting of the heating current during a period preceding an emission and, after this period, to subject the heating element to a current whose intensity has an intermediate value between the holding value and the value of the boost current; and means for determining the value of the boost current, emission by emission, as a function of the holding value and the intermediate value;

wherein the means for determining the value of the boost current comprises a model of evolution of the heating current, such that, emission by emission, the value of the boost current is allowed to differ.

24. The source according to claim 23 wherein the model of evolution being a model that produces a minimizing of a source current error between a source current that is expected for the source and a source current obtained.

25. The source according to claim 23 wherein the model implements the following equations:

$$ip = ib - \frac{ib - i0}{(\tau(ib)/\tau(i0)) \cdot (e^{t/\tau(ib)} - 1) + 1}.$$

$$\text{with } .\tau(ib) = 1/(a + b*ib + c*ib + d*ib*ib), \text{ and}$$

$$\text{with } .\tau(i0) = 1/(a + b*ib + c*i0 + d*ib*i0);$$

where ip is the element current at the beginning of emission; ib is the boost element overcurrent; i0 is the initial current; t is a constant; and a–d are parameters of the source; and wherein the boost current value ib is determined by iterations, the value i0 of the holding current and the intermediate value ip being known.

26. The source according to claim 25 wherein the parameters a, b, c, and d have the following values, depending on whether the cathode produces a small focal spot or a large focal spot on the anode:

small focal spot: a=−0.9658; b=0.0504; c=0.4072; d=0.0124 large focal spot: a=−0.4045; b=0.0416; c=0.2663; d=0.0215.

* * * * *

UNITED STATES PATENT AND TRADEMARK OFFICE

CERTIFICATE OF CORRECTION

PATENT NO. : 7,079,622 B2
APPLICATION NO. : 10/841134
DATED : July 18, 2006
INVENTOR(S) : Patrick Chretien It is certified that error appears in the above-identified patent and that said Letters Patent is hereby corrected as shown below:

Title Page,
Insert --Item [30] Foreign Application Priority Data
May 20, 2003 (FR) 03 50162 --
Item [54], before "RADIATION" Insert --EMITTED--

Column 1,
Line 3, before "RADIATION" insert --EMITTED--

Column 2,
Line 56, after "However", delete "modem" and insert therefor --modern --

Column 7,
Line 1, after "constant" delete "T" and insert therefor -- $\tau$ --

Signed and Sealed this

Nineteenth Day of December, 2006

JON W. DUDAS
*Director of the United States Patent and Trademark Office*